US005299332A

United States Patent [19]

Perng

[11] Patent Number: 5,299,332

[45] Date of Patent: Apr. 5, 1994

[54] ALARM APPARATUS FOR A QUILT SLIPPING OFF

[76] Inventor: Gin S. Perng, 32, Lane 455, Sec. 3, Yean Pin Road, Hsinchu, Taiwan

[21] Appl. No.: 58,353

[22] Filed: May 10, 1993

[51] Int. Cl.[5] ..... A47G 9/00; A47G 9/02

[52] U.S. Cl. ..... 5/494; 5/482; 5/658; 340/568; 340/573

[58] Field of Search ..... 5/494, 500, 502, 482, 5/658, 424; 340/568, 573, 575

[56] References Cited

U.S. PATENT DOCUMENTS 4,242,672 12/1980 Gault ..... 340/573

4,411,034 10/1983 Williams ..... 5/494

*Primary Examiner*—Alexander Grosz

*Attorney, Agent, or Firm*—Morton J. Rosenberg; David I. Klein

[57] ABSTRACT

A quilt system having an alarm for indicating when it has slipped off a user is provided. The system includes a quilt having arranged on an inside surface thereof, a plurality of rubber conductors coupled to form two groups of alternating conductors, and a belly-band having a conductive rubber layer disposed on an outside surface thereof. An integrated circuit chip is provided in the quilt and coupled to the rubber conductors thereof for sensing electrical contact between the quilt and the belly-band conductor. A buzzer is coupled to the integrated circuit for indicating a loss of contact between the conductors of the quilt with the belly-band conductor. When the quilt is in contact with the belly-band, the buzzer or oscillator of the integrated circuit chip is kept in its normal inactive state. However, if the quilt moves, and no longer contacts the belly-band, the circuitry of the integrated circuit chip will act as an open-circuit detector, enabling the buzzer to sound, or having a radio emitter circuit transmit a signal to a portable receiver to alert a remotely located person.

2 Claims, 5 Drawing Sheets

ALARM APPARATUS FOR A QUILT SLIPPING OFF

BACKGROUND OF THE INVENTION

Conventionally, parents often have babies or children wear a belly-band of proper size when they go to sleep to avoid getting a cold due to a quilt slipping off. Although this method is partially effective in protection, it cannot eliminate the possibility of catching cold because temperature drops in the night. Moreover, nowadays many children sleep in their own bedrooms, not with their parents together, so getting cold due to a quilt slipping off is almost inevitable.

OBJECT OF THE INVENTION

In view of the above stated annoyances and inconvenience, the principal object of the invention is to provide an alarm apparatus in which rubber conductors and an integrated circuit chip makes up of a circuitry that can alert parents, in conjunction with a buzzer or a radio wave receiver, to replace the quilt when a quilt slips off and thus a careless neglect leading to have cold can be avoided.

The objects, the advantages, and the features of the invention will be more apparent from the following detailed description of an embodiment thereof taken in connection with the accompanying drawings.

BRIEF DESCRIPTION OF THE DRAWINGS

FIGS. 1A and 1B are plan views showing a belly-band and a quilt of the invention.

FIG. 1C is a cross sectional view of the quilt of FIG. 1B.

DETAILED DESCRIPTION

Figure 1A:
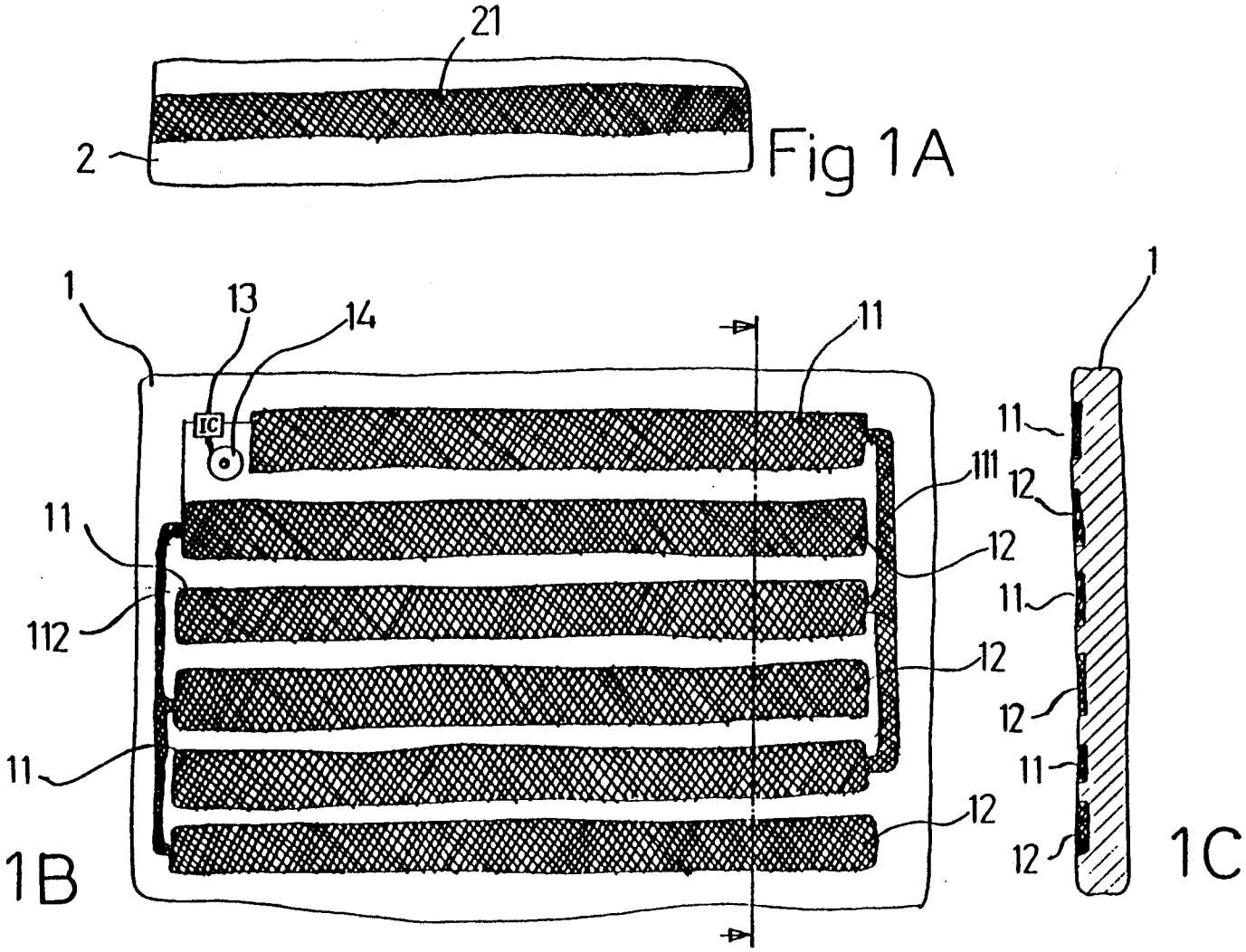
Figure 2:
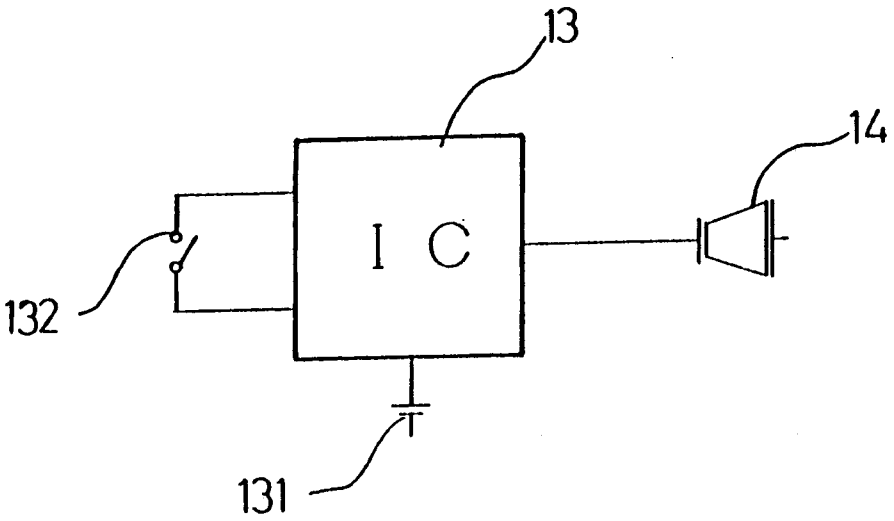
FIG. 2 is a schematic diagram of the integrated circuit chip.

In FIGS. 1 and 2, an alarm apparatus for a quilt slipping off according to the invention comprises a quilt (1) and a belly-band (2); a few rubber conductors (11), (12) externally connected with connecting portions (111), (112) being alternately arranged on the inside surface of the quilt and between them being provided an open-circuit detector consisting of an integrated circuit chip (13) connecting a dry battery (131) to a switch (132) and an external buzzer (14), the belly-band (2) further having a rubber conductor (21) disposed the outside surface thereof.

Figure 3:
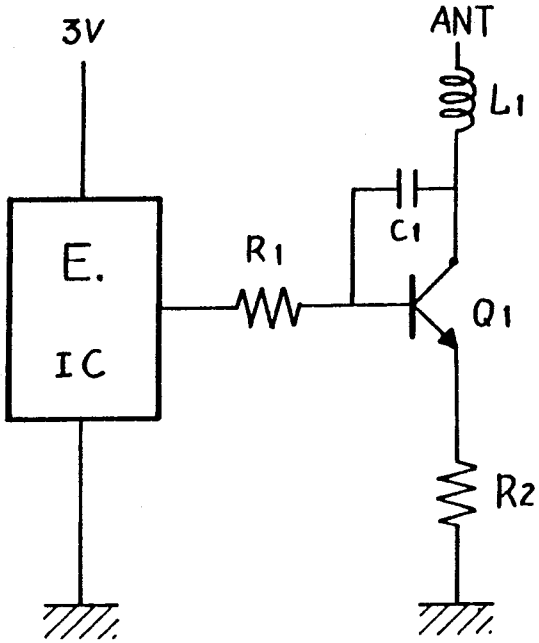
Fig. 3 (prior art)
FIG. 3 is a schematic diagram of the emitter circuit.
Figure 4:
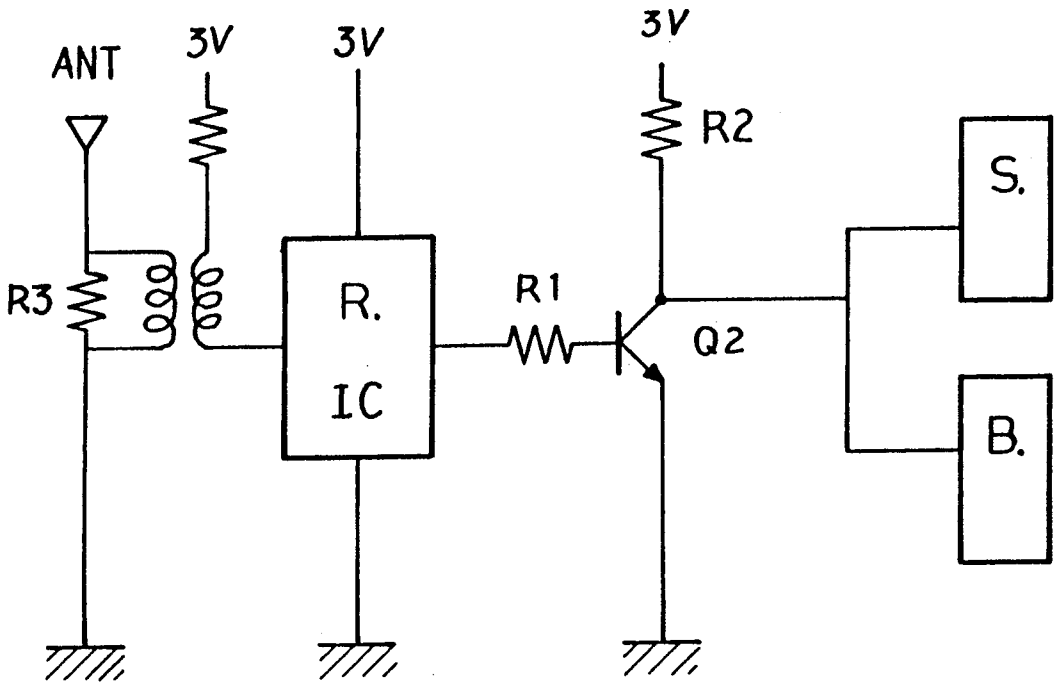
Fig. 4 (prior art)
FIG. 4 is a schematic diagram of the receiver circuit.

As shown in FIG. 3, the foregoing integrated circuit chip (13) is equipped with an emitter circuit that can generate signals through an antenna when it is closed. On the other hand, another receiver having a circuitry as indicated in FIG. 4 is suitable to be carried by baby sitters or parents, which circuitry is known to skill, not included in the claims of the invention, and so not detailed here. Instead, the invention is characterized by the radio transmitting and receiving functions conferred upon the integrated circuit chip and controlled by the rubber conductors of the quilt and the belly-band.

Figure 5:
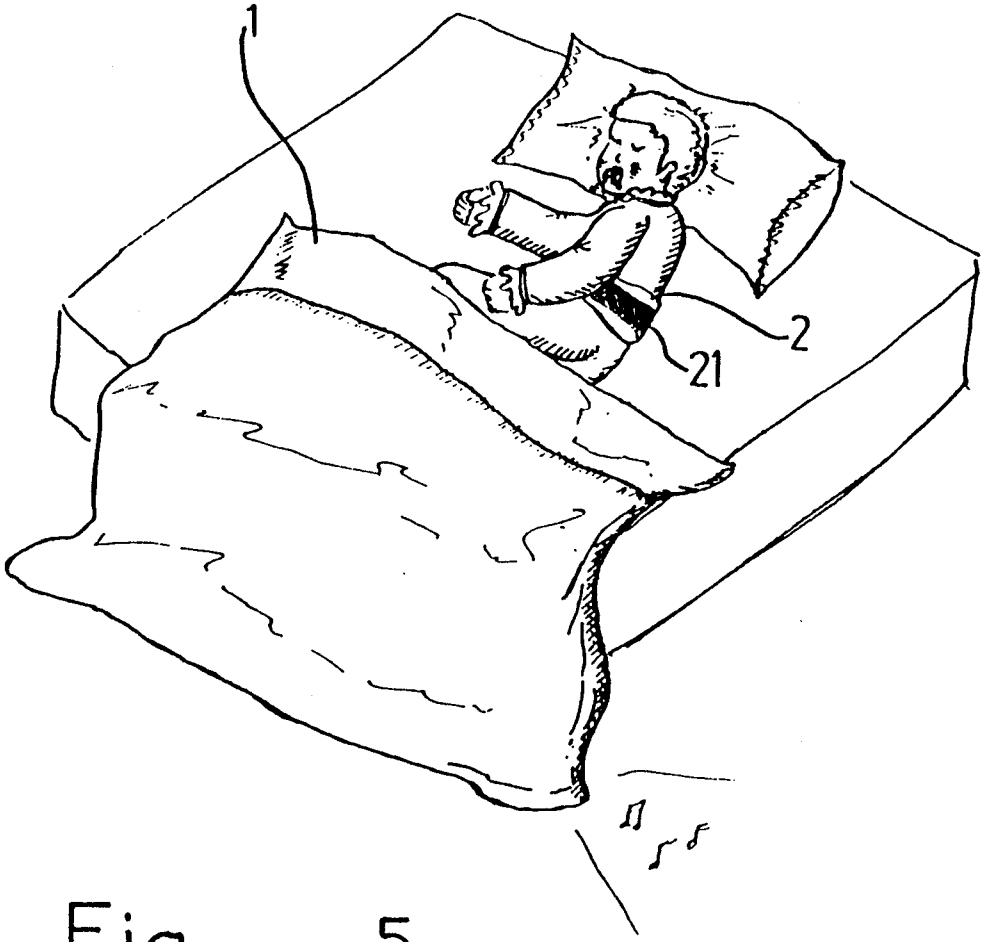
FIG. 5 is a schematic view showing an exemplified embodiment of the invention in use.

Referring now to FIG. 5, in a normal covering state the rubber conductors (11), (12) arranged on the inside surface of a quilt can contact a belly-band wrapped around children's waists and so they form a closed circuit with the rubber conductors (21) of the belly-band (2). If children's turning over or subconscious behavior during sleeping leads to a quilt slipping off, the contact between the rubber conductors of the quilt (1) and the belly-band (2) is interrupted so that the closed loop consisting of the switch (132), the rubber conductors (11), (12) of the quilt, and the integrated circuit chip (13) is opened at the switch (132), which results in the buzzer (14) of the integrated circuit chip (13) sounding as well as signals emitted by an emitter circuit to a receiver that produces alarms in a sound or vibration form to alert parents. When the quilt is replaced to its initial proper position and contacts the rubber conductors (21) of the belly-band (2) again, the rubber conductors (11), (12) of the quilt, the rubber conductors (21) of the belly-band and the integrated circuit chip (13) make up a closed loop and so the buzzer's sounding will stop immediately, making it easier for children's sleeping.

As the described above, the invention is an alarm apparatus of practical value, providing a combination of quilts, belly-bands, and rubber conductors accompanying with an integrated circuit chip, buzzers, and a radio sensing device to warn parents that the quilt covering children slips off and should be replaced in time to avoid getting a cold.

What is claimed is:

1. An alarm apparatus for indicating a condition where a quilt has slipped off a user, comprising:

a quilt (1) having (a) a plurality of first conductors (11) interposed between a plurality of second conductors (12) on a bottom surface thereof, each of said first conductors (11) being electrically coupled one to the others, each of said second conductors (12) being electrically coupled one to the others, (b) a battery power source (131), (c) a detection circuit (13) coupled to said battery power source (131) and said first and second conductors for providing an enabling output signal responsive to detection of an open circuit condition between said first and second conductors, and (d) signal means (14) coupled to said detection circuit (13) for indicating said open circuit condition responsive to receipt of said enabling output signal from said detection circuit (13); and, means (2, 21) for electrically connecting at least one of said plurality of first conductors to at least one of said plurality of second conductors coupled to a user, said coupling means being defined by and elongated band member (2) circumferentially disposed about a user's body, said band member (2) having a third conductor (21) extending longitudinally on an upper surface of said band member for contiguous contact with at least one of each of said first and second conductors when said quilt overlays the user, whereby said signal means provides an alarm indication responsive to said quilt being sufficiently displaced from said user to separate said third conductor from contact with said first and second conductors.

2. The alarm apparatus as recited in claim 1 where each of said first and second conductors and said third conductor are formed of a conductive rubber composition.

* * * * *